US008162110B2

(12) United States Patent
Smith et al.

(10) Patent No.: US 8,162,110 B2
(45) Date of Patent: Apr. 24, 2012

(54) ROPE TENSION EQUALIZER AND LOAD MONITOR

(75) Inventors: Rory S. Smith, El Cajon, CA (US); Alan M. Parker, Descanso, CA (US); Chi Phan, San Marcos, CA (US)

(73) Assignee: ThyssenKrupp Elevator Capital Corporation, Troy, MI (US)

( * ) Notice: Subject to any disclaimer, the term of this patent is extended or adjusted under 35 U.S.C. 154(b) by 442 days.

(21) Appl. No.: 12/488,120

(22) Filed: Jun. 19, 2009

(65) Prior Publication Data

US 2009/0314584 A1 Dec. 24, 2009

Related U.S. Application Data

(60) Provisional application No. 61/073,911, filed on Jun. 19, 2008.

(51) Int. Cl.
*B66B 1/34* (2006.01)

(52) U.S. Cl. ..... 187/393; 187/412; 187/266

(58) Field of Classification Search ..... 187/266, 187/277, 281, 343, 350, 391–393, 406, 412; 73/1.09, 1.13, 1.15, 763, 783, 796, 811; 177/132, 177/142, 147

See application file for complete search history.

(56) References Cited

U.S. PATENT DOCUMENTS

| | | | |
|---|---|---|---|
| 1,507,712 | A | 9/1924 | Proudfoot |
| 1,725,402 | A | 8/1929 | Lindquist |
| 1,915,486 | A | 6/1933 | Frost |
| 1,940,249 | A | 12/1933 | Evans |
| 2,020,920 | A | 11/1935 | Vanderzee |
| 2,837,292 | A | 6/1958 | Adamson |
| 3,343,810 | A | 9/1967 | Parnell |
| 4,793,442 | A | 12/1988 | Heckler et al. |
| 4,986,391 | A | 1/1991 | Salmon |
| 5,156,239 | A | 10/1992 | Ericson et al. |
| 5,172,782 | A | 12/1992 | Yoo et al. |
| 5,241,141 | A | 8/1993 | Cominelli |
| 5,306,879 | A | 4/1994 | Pearson |

(Continued)

FOREIGN PATENT DOCUMENTS

GB 1006905 10/1965

(Continued)

OTHER PUBLICATIONS

Beus, M.J., Ruff, T.M, McCoy, W.G., "Conveyance Monitoring to Improve Mine Hoisting Safety," *Industry Applications Conference*, 1997, *Thirty-Second IAS Annual Meeting, IAS* '97., *Conference record of the* 1997 *IEEE*, vol. 3 (Oct. 5-9, 1997), Abstract p. 2091.

(Continued)

*Primary Examiner* — Anthony Salata
(74) *Attorney, Agent, or Firm* — Frost Brown Todd LLC

(57) ABSTRACT

An apparatus for automatically equalizing the uneven tension between ropes of an elevator in combination with a load cell to determine elevator load. The load of an elevator car having multiple tension members is automatically balanced while load is measured using a single load cell. The incorporation of a load cell with an autobalancing system allows for an accurate measure of an elevator load to be taken while providing the benefits of having uniform rope lengths in the elevator system. The apparatus may have various arrangements, including an in-line configuration and a grouped configuration. The apparatus may also dampen the vibration energy that is usually imparted to an elevator car.

20 Claims, 5 Drawing Sheets

U.S. PATENT DOCUMENTS

| | | | | |
|---|---|---|---|---|
| 5,345,042 | A | 9/1994 | Jamieson | |
| 5,421,433 | A | 6/1995 | Yoo | |
| 5,437,347 | A | 8/1995 | Biewald et al. | |
| 5,441,127 | A * | 8/1995 | Ikejima et al. | 181/292 |
| 5,526,754 | A | 6/1996 | Kunczynski | |
| 5,641,041 | A | 6/1997 | Masuda et al. | |
| 5,728,953 | A | 3/1998 | Beus et al. | |
| 5,788,018 | A | 8/1998 | Mendelson et al. | |
| 5,861,084 | A | 1/1999 | Barker et al. | |
| 5,862,888 | A | 1/1999 | Iwakiri et al. | |
| 5,894,910 | A | 4/1999 | Suur Askola et al. | |
| 5,959,266 | A | 9/1999 | Uchiumi | |
| 6,021,873 | A | 2/2000 | Aulanko et al. | |
| 6,123,176 | A * | 9/2000 | O'Donnell et al. | 187/393 |
| 6,193,017 | B1 | 2/2001 | Köster | |
| 6,325,179 | B1 | 12/2001 | Barreiro et al. | |
| 6,450,299 | B1 | 9/2002 | Lysaght | |
| 6,483,047 | B1 | 11/2002 | Zaharia et al. | |
| 6,715,587 | B2 | 4/2004 | Sittler et al. | |
| 6,840,326 | B2 | 1/2005 | Shiyou | |
| 7,011,184 | B2 | 3/2006 | Smith et al. | |
| 7,207,421 | B2 * | 4/2007 | Aulanko et al. | 187/266 |
| 7,225,901 | B2 | 6/2007 | Mustalahti et al. | |
| 7,481,299 | B2 * | 1/2009 | Mustalahti et al. | 187/264 |
| 7,631,731 | B2 * | 12/2009 | Maki et al. | 187/393 |
| 7,650,972 | B2 * | 1/2010 | Aulanko et al. | 187/350 |
| 7,721,852 | B2 * | 5/2010 | Ishioka et al. | 187/391 |
| 7,802,658 | B2 * | 9/2010 | Aulanko et al. | 187/266 |
| 2004/0154875 | A1 | 8/2004 | Bass et al. | |
| 2004/0154876 | A1 * | 8/2004 | Choi | 187/412 |
| 2005/0087404 | A1 | 4/2005 | Barrett et al. | |
| 2005/0230192 | A1 | 10/2005 | Brant | |
| 2006/0250381 | A1 | 11/2006 | Geaghan | |
| 2006/0289246 | A1 | 12/2006 | Aulanko et al. | |
| 2007/0151773 | A1 | 7/2007 | Gallegos | |
| 2007/0151810 | A1 | 7/2007 | Aulanko et al. | |
| 2007/0227825 | A1 | 10/2007 | Siewert et al. | |
| 2007/0272906 | A1 | 11/2007 | Davidson | |
| 2008/0073159 | A1 | 3/2008 | Al-Fayez | |

FOREIGN PATENT DOCUMENTS

| | | |
|---|---|---|
| JP | 6255933 | 9/1994 |
| JP | 2005145620 | 6/2005 |
| JP | 2006052040 | 2/2006 |
| WO | WO 89/05747 | 6/1989 |
| WO | WO 2004/024609 | 3/2004 |
| WO | WO 2004/069716 | 8/2004 |
| WO | WO 2005/115907 | 12/2005 |
| WO | WO 2007/075225 | 7/2007 |
| WO | WO 2007/116119 | 10/2007 |
| WO | WO 2008/000886 | 1/2008 |
| WO | WO 2009/143450 | 11/2009 |

OTHER PUBLICATIONS

Beus, M.J.; McCoy, W.G., "Mine Shaft Conveyance Load-Monitoring System," *Conference Record of the* 1995 *IEEE Industry Applications Conference, Thirtieth IAS Annual Meeting*, vol. 3, (Oct. 8-12, 1995), Abstract p. 2048.

Farley, H.L.; Fish, R.B.; Jeffcoat,R.l.; Hoadley, D.L., "Slack and Overload Rope Protection System," Bureau of Mines, Washington, D.C., *BUMINES-OFR*-213-83, Jan. 1983, Abstract p. 328.

Kimura, Hiroyuki and Nakagawa, Toshiaki, "Vibration Analysis of Elevator Rope with Vibration Suppressor," *Journal of Environment and Engineering*, vol. 2, No. 1 (2007), pp. 76-86.

* cited by examiner

ROPE TENSION EQUALIZER AND LOAD MONITOR

PRIORITY

This application claims priority to and benefit of U.S. Provisional Application No. 61/073,911, filed on Jun. 19, 2008, which is herein incorporated by reference in its entirety.

FIELD

Embodiments of the present invention relate, in general, to an apparatus for determining the load of an elevator and, more particularly, to an apparatus for automatically equalizing uneven tension of ropes of an elevator in combination with a load cell to determine elevator load.

BACKGROUND

When an elevator having a plurality of ropes for supporting a load is initially installed, or when ropes are exchanged, it may be difficult to precisely match the lengths of the ropes due to a variety of factors, such as the rigidity of the wire ropes and the misalignment of equipment providing tension to the ropes. Other factors causing a difference in length among the ropes may include the differential expansion rate of the ropes, a fault of a sheave material or rope material, an eccentric load applied to an elevator car, and/or combinations thereof. These factors, and others, may result in length differences between the ropes, which can have negative consequences. For instance, if a length difference exists between the ropes of an elevator system, the ropes may be subject to uneven tension because the load is unevenly applied to the ropes. Due to a variation in length among ropes, the ropes having relatively short lengths when compared to the others may be subject to over-tension such that the wires of those ropes are often rapidly worn. In addition, the ropes having relatively short lengths may be easily deformed or broken while causing early wear of sheave grooves and other components. Furthermore, an unbalanced load between the ropes may generate vibrations in longitudinal and transverse directions, which may be directly transferred to the elevator car, making passengers feel uneasy. The above-described situation may be similar to a situation involving a vehicle having an inferior wheel alignment, which can shorten the life span of related components including tires and can deteriorate steering performance and riding comfort.

The load of an elevator car may be measured with a load cell associated with a load weighing hitch plate or by associating a plurality of load cells with a plurality of suspension ropes to determine the cumulative load of the elevator car. The hitch plate system may be supported by a support frame suspended by traction cables or ropes. The hitch plate and load cell may often be coupled directly to the elevator car and connect the car to an upper crossbeam or yoke operatively connected with the hoist or traction cables or ropes. In this manner, the load of the car may be measured at a single point at the center of the elevator car.

Other load measuring systems may incorporate a load measurement device located at the dead end hitch. In such systems, the tension member terminations is mounted to a bracket, which is in turn mounted to a plate. The plate is attached to a guiderail to fix the tension members relative to the hoistway. An edge flange is attached to the plate opposite the guiderails and a strain gauge is attached to the flange. The load exerted by the car suspended by the tension members is transmitted by the plate to the edge flange which is designed such that the force applied to the edge plate by the hoisting ropes causes a large deformation in the edge flange. The strain in the edge flange may be measured by the strain gauge. In other systems, a load weighting device may be used (with a set of springs) to determine the car weight by measuring the compression of the springs.

An alternative configuration for monitoring the load of an elevator car may utilize multiple tension members associated with multiple load cells. A load weighing device for an elevator may be located at the termination of each tension member for suspending the elevator car. A typical system includes an elevator car and counterweight suspended by a tension member within a hoistway. Terminations are fixed to the end of the tension member, which are in turn attached to a structure such as a mounting plate or beam that is fixed relative to the hoistway. A load cell is fixed between a spring and a mounting plate such that the load cell measures the weight borne by the tension member. For elevators having multiple tension members, there may be a load cell for each tension member. The total load of the elevator car is then measured by adding each of the loads measured at each of the plurality of tension members.

Thus, having uneven tension between tension members of an elevator system may not only reduce the service life of the tension members and affect the quality of a passenger's ride, but also it may even jeopardize the safety of the lift operation. Therefore, it may be advantageous to provide an elevator load measurement system for an elevator system having a plurality of tension members that compensates for the differences in rope length of the tension members and accurately measures the load of an elevator car with a single load cell. It may also be advantageous to provide such an elevator load measurement system that works in real time. Furthermore, it may be advantageous to provide an elevator load measurement system that dampens any vibration energy in the tension members.

BRIEF DESCRIPTION OF THE DRAWINGS

The accompanying drawings incorporated in and forming a part of the specification illustrate several aspects of the present invention, and together with the description serve to explain the principles of the invention; it being understood, however, that this invention is not limited to the precise arrangements shown. In the drawings, like reference numerals refer to like elements in the several views. In the drawings.

DETAILED DESCRIPTION

Versions described herein are configured to provide an apparatus for equalizing the tension between the ropes of an elevator in real time in combination with a load cell for monitoring the load of an elevator car. As used herein, the term "rope" will refer to any tension member suitable for use in the disclosed elevator system and apparatus, including but not limited to a rope, cable, chain, or other tension member or suspension means. In one version, the load of an elevator car having a plurality of ropes is automatically balanced while load is measured using a single load cell. The incorporation of a load cell with an autobalancing system permits an accurate measure of an elevator load to be taken while providing the benefits of having uniform rope lengths in the elevator system. Such a system may also account for and measure eccentric or uneven loads in an elevator system using only a single load cell. Thus, the number of load cells needed to take an accurate measure of an elevator system having multiple ropes may be reduced while at the same time the system may automatically adjust the lengths of the ropes to improve the useful life of the system and improve rider comfort. Furthermore, use of an aramid fiber rope, such as Kevlar®, may further improve the system by damping longitudinal and transverse vibrations that may cause rider discomfort.

Figure 1:
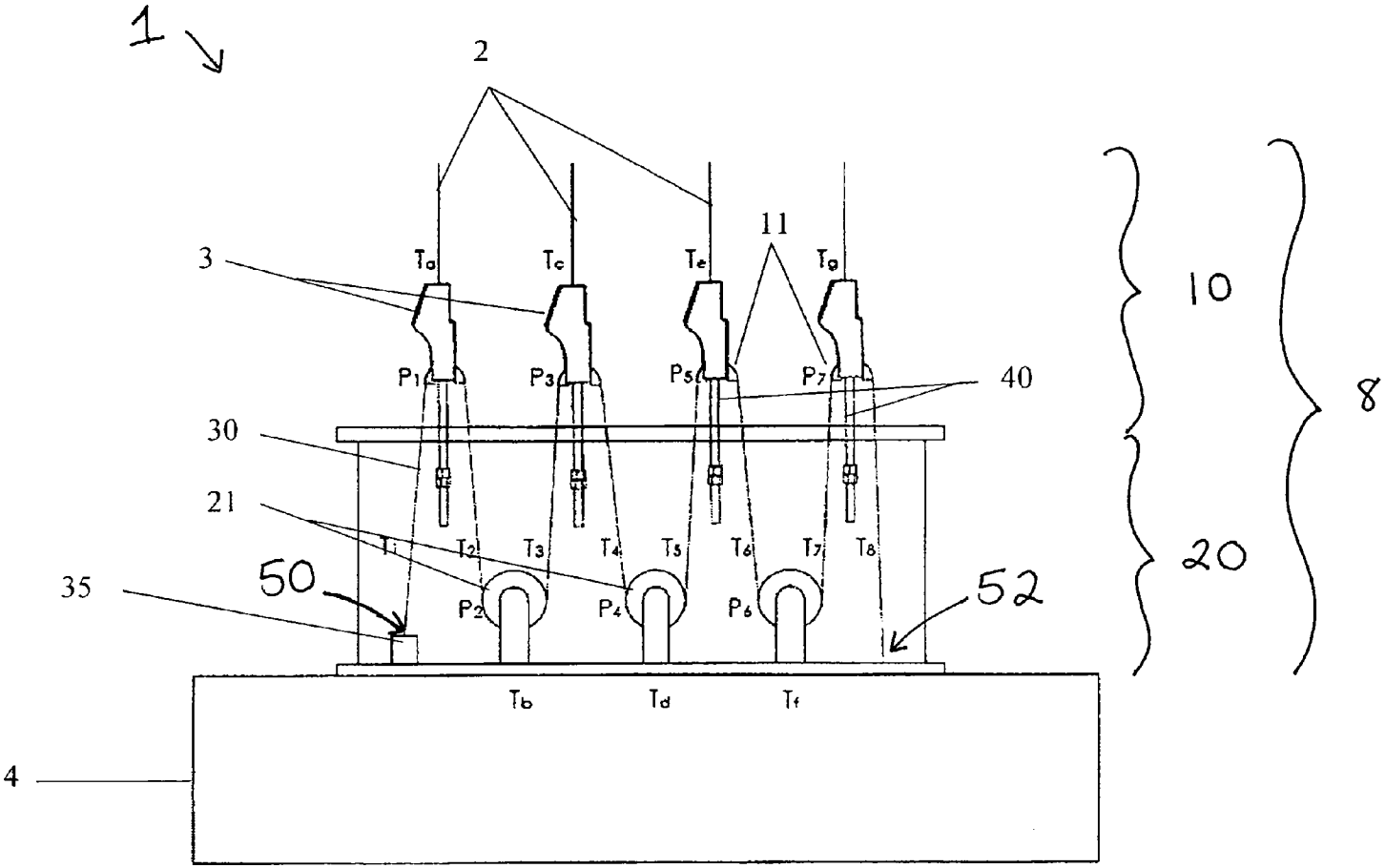
FIG. 1 is a schematic view of one version of an apparatus for equalizing the tension between the ropes of an elevator system having in-line sheaves.

Referring to FIG. 1, an elevator system (1) for equalizing the tension of the ropes (2) and balancing an elevator car (4) comprises an elevator car (4) and an apparatus (8) for equalizing the tension between the elevator ropes (2). Ropes (2) of the apparatus (8) are suspension ropes that may be coupled to terminations at the roof of a hoistway. Each rope (2) has a tension (Ta, Tc, Te, and Tg). The sheave balancing apparatus (8) further comprises an upper sheave section (10) and a lower sheave section (20), where the upper sheave section (10) includes a plurality of sheaves (11) that are coupled to the ropes (2) through rope coupling members (3) and rods (40). For example, FIG. 1 shows four upper sheaves (P1, P3, P5, and P7). The lower sheave section (20) is supported by the elevator car (4) and includes a plurality of fixed sheaves (21) and a compensating rope (30) supporting section. For example, FIG. 1 shows three lower sheaves (P2, P4, P6, and P8). Each lower sheave (21) may also have a tension (Tb, Td, and Tf). The compensating rope (30) is aligned with the upper sheave section (10) and the lower sheave section (20) while being supported by the lower sheave section (20) such that each section (T1-T8) of the compensating rope (30) has a uniform tension when the elevator car is loaded. The sheave apparatus (8) may be distributed along the length of the roof of the elevator car (4) to effectively balance eccentric loads. Versions of this rope tension equalizer (8) can accurately measure the load of the car (4), because all sections (T1-T8) of the compensating rope (30) must share the same load.

In the illustrated version, ropes (2) are associated with the compensating rope (30) via the rope coupling members (3), rods (40), and the upper sheave section (10). In this position, if a relative length difference occurs between ropes (2), or if there is an eccentric load in the elevator car (4), the compensating rope (30) is subject to uneven tension so that movement of the compensating rope (30) and rotation of sheaves (11), (21) may simultaneously occur, thereby compensating for the relative length difference or the uneven load. In one version, the relationship is such that even if a small amount of uneven tension occurs in the compensating rope (30), the sheaves (11), (21) will carry out a balancing action regardless of an amount of load applied to the compensating rope (30).

It will be appreciated that the upper sheave section (10) and lower sheave section (20) may be aligned in any suitable configuration such as a linear, circular or grouped pattern. Although not illustrated, it is also possible to align the movable sheaves (11) in two or three rows, or in a lozenge pattern, depending on an alignment of the fixed pulley sheaves (21).

Referring to FIG. 1, each rope (2) may be associated with a single sheave (11) of the upper sheave portion (10). Thus, each rope (2) may have a corresponding sheave (11) in the upper sheave section (10). A corresponding sheave (21) in the lower sheave section (20) may also be present for each rope (2). The rope tension equalizer apparatus (8) may be used with any suitable number of ropes (2) and sheaves (11), (21) as will be appreciated by one of ordinary skill in the art. In the illustrated version, each of the four ropes (2) is associated with a simple sheave (11) supporting a portion of the compensation rope (30). The compensation rope (30) is threaded through each sheave (11) of the upper sheave section (10) and each sheave (21) of the lower sheave section (20) such that a single compensation rope (30) couples the elevator car (4) with the ropes (2). Compensation rope (30) has two free ends. One free end (50) of the compensation rope (30) is coupled with a load cell (35) and the other free end (52) is affixed to the elevator car (4).

When suspended in such a manner, gravitational forces acting on the elevator car (4) will cause the tension on the compensation rope (30) to evenly disperse amongst the portions of the rope (T1-T8) between the upper sheave region (10) and lower sheave region (20). The equal distribution of the load results from the autobalancing of the system (1). A balancing of eccentric loads, in particular, may help to reduce the strain on elevator components and may improve rider comfort due to the minimization of transverse and longitudinal vibrations that can result from varying rope lengths. Vibrations may further be damped by the use of an aramid or para-aramid fiber rope, such as a material made from long molecular chains produced from PPTA (poly-paraphenylene terephthalamide) commonly known as Kevlar®, for the compensation rope (30). Ropes constructed from such materials have a natural damping effect that may further reduce vibration. The use of aramid ropes, such as a ¼" Kevlar rope, may reduce the D/d ratio, which is the ratio between the sheave diameter and the rope diameter. A smaller D/d ratio may allow for the overall system (1) to be more compact. Additional damping features, such as springs, may be used, however the damping effects of aramid rope may be sufficient to eliminate additional damping components altogether. Although the illustrated system (1) is passive in that only gravitational forces are used to balance the elevator load, it will be appreciated that active systems, such as those incorporating a drive system or motor, may be utilized.

A load cell (35) may be positioned between one end of the compensation rope (30) and the elevator car (4). As illustrated in FIG. 1, load cell (35) is positioned at end (50) of the compensation rope (30). It will be appreciated that the load cell (35) may be placed anywhere along the length of the compensation rope (30). The section (T1) of compensation rope (30) between the load cell (35) and the first sheave (11) of the upper sheave section (10) will, once the apparatus (8) is balanced, have the same tension as that applied to each of the sections T2-T8 of the compensation rope (30). Thus, the total load of the elevator car can be calculated by simply multiplying the load of the section T1 by the number of such sections present in the system.

For example, the uniformity of the autobalancing system (1) allows for an accurate load measurement to be taken with only a single load cell (35) at a terminus of the compensation rope (30). The load cell (35) can be associated with any suitable programmable processor to input the proper algorithm to ascertain load based upon the load cell (35) measurement and the number of sheaves and rope sections. Thus, only a single load cell (35) may be necessary to measure the load of the elevator car (4). Additionally, because the autobalancing system (1) will account for eccentric loads, the load measurements may be more accurate than systems that utilize springs or take measurements from only a single location. Improved accuracy in load monitoring may help the system function more effectively and efficiently in determining how to respond to hall calls, high traffic, and overloaded situations. By using this rope tension equalizer (8) the ride quality, rope life, sheave life, traction performance, and safety operation may be improved.

It will be appreciated that versions of the system (1) can be configured for use in high rise, mid rise, and low rise applications and can be used with any suspension means including wire rope, synthetic rope, a belt system, a chain system, and combinations thereof. It will also be appreciated that using a single load cell is not required and that numerous load cells may be used, such as for redundant monitoring, or for any other suitable purpose.

Figure 2:
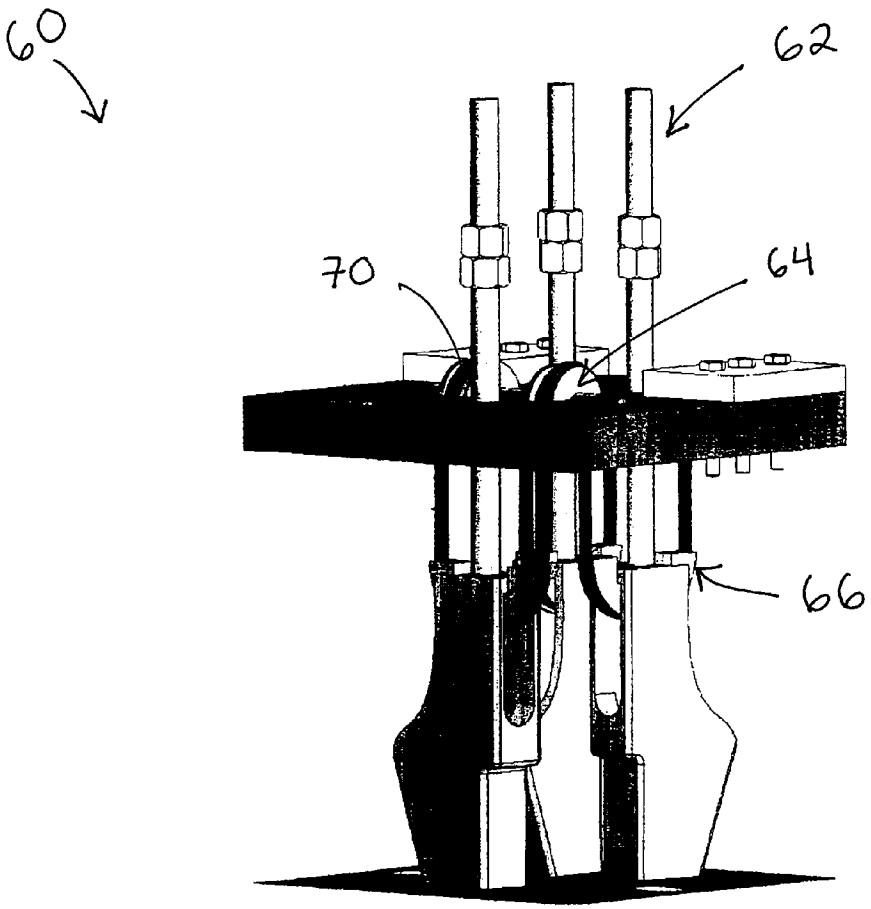
FIG. 2 is an isometric view of an alternative version of an apparatus for equalizing the tension between the ropes of an elevator system having grouped sheaves.
Figure 3:
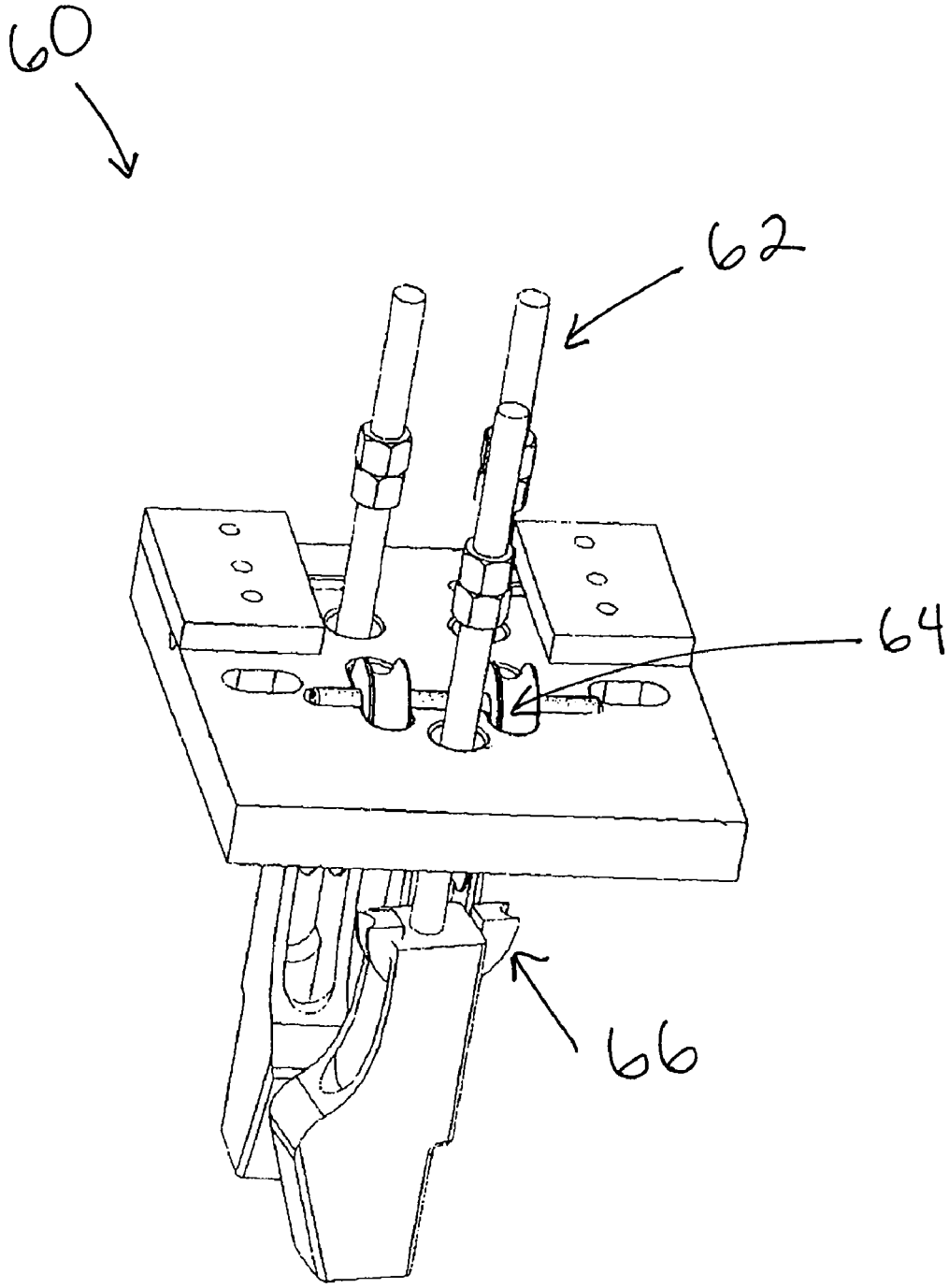
FIG. 3 is a top plan view of the apparatus of FIG. 2.
Figure 4:
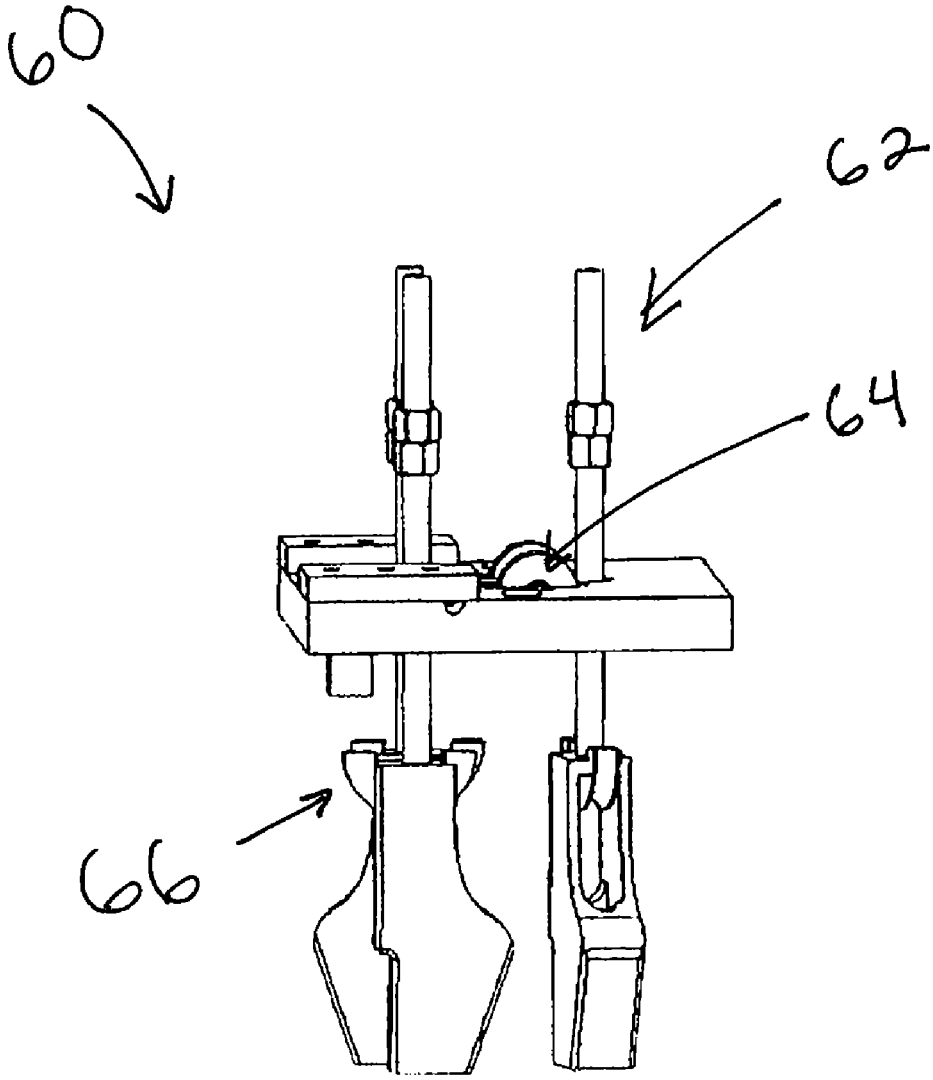
FIG. 4 is a side view of the apparatus of FIG. 2.

FIGS. 2-4 illustrate another particular embodiment of a rope tension equalizer. Whereas FIG. 1 displays an embodiment of a rope tension equalizer (8) having an in-line configuration, FIGS. 2-4 show a rope tension equalizer (60) having a grouped configuration. In all other respects, the apparatus (60) may operate in the same or similar fashion to the apparatus (8) disclosed in FIG. 1. For example, the rope tension equalizer (60) of FIGS. 2-4, comprises ropes (62), sheaves (64) and (66), and a compensation rope (70). FIGS. 3-4 show the structure of rope tension apparatus (60) without a compensation rope (70). It will be appreciated that any suitable arrangement, such as an in-line configuration or a grouped configuration, may be utilized in accordance with versions herein. The particular configuration selected may depend on available space or other restrictions.

Figure 5:
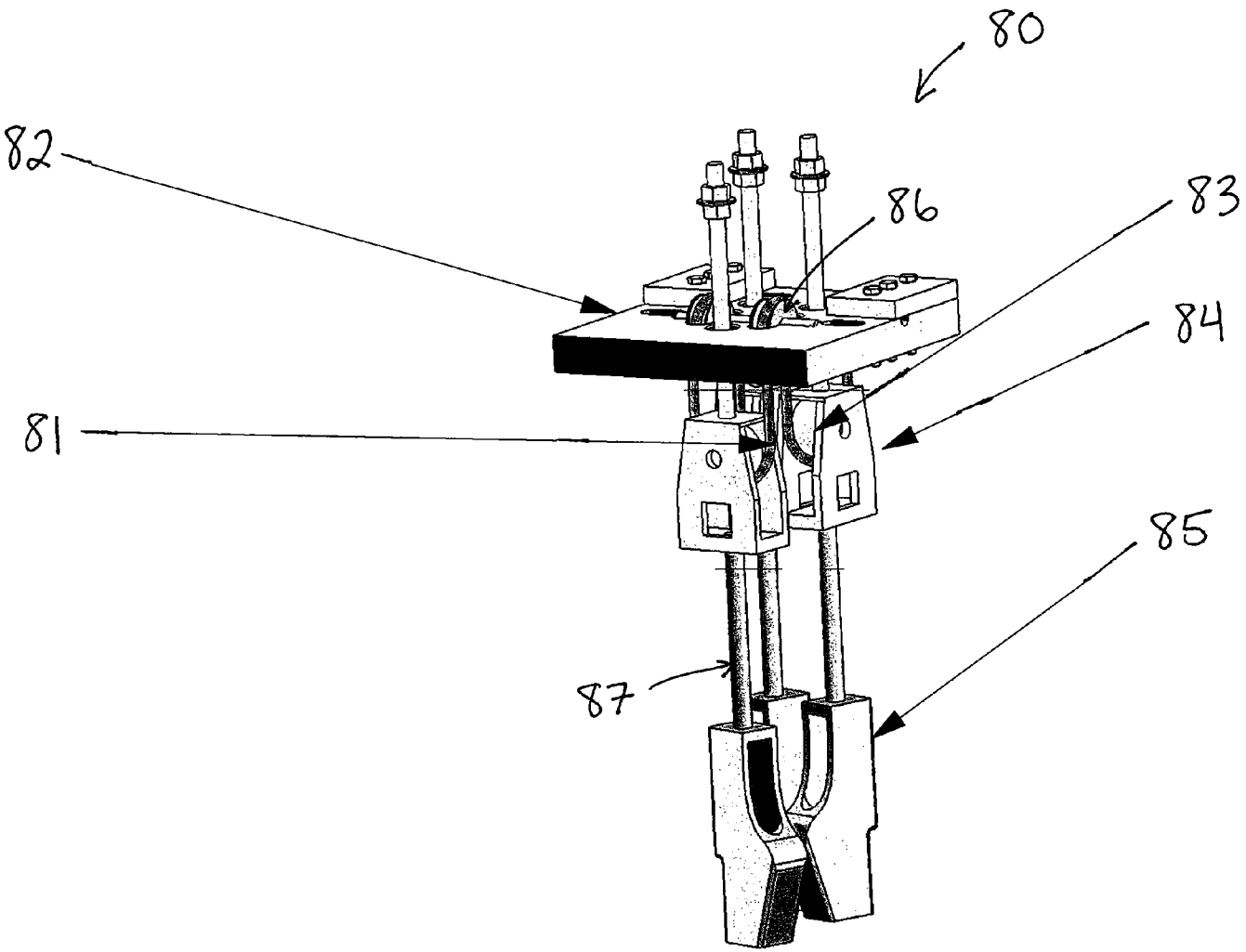
FIG. 5 is an isometric view of another version of an apparatus for equalizing the tension between the ropes of an elevator system using a full sheave.

FIG. 5 illustrates yet another particular embodiment of a rope tension equalizer. Whereas the previous embodiments employ a half sheave at the termination, FIG. 5 shows a rope tension equalizer (80) utilizing a full sheave (83) with bearing. In all other respects, the apparatus (80) may operate in the same or similar fashion to apparatuses (8) and (60) shown in FIGS. 1-4 and described above. For example, the rope tension equalizer (80) of FIG. 5, comprises a compensation rope (81), sheaves (86) and (83). In addition, apparatus (80) further comprises a hitch plate (82) for mounting sheave (86), a termination (85) fixed to the end of rope (87), and a bracket, (84) for mounting sheave (83). It will be appreciated that any suitable arrangement, such as an in-line configuration or a grouped configuration, may be utilized in accordance with versions herein. The particular configuration selected may depend on available space or other restrictions.

In summary, numerous benefits have been described which result from employing the concepts of the invention. The foregoing description of one or more embodiments of the invention has been presented for purposes of illustration and description. It is not intended to be exhaustive or to limit the invention to the precise form disclosed. Obvious modifications or variations are possible in light of the above teachings. The one or more embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A rope tension equalizer apparatus comprising:

(a) an upper sheave section, the upper sheave section having a plurality of upper sheaves;

(b) a lower sheave section, the lower sheave section having a plurality of lower sheaves;

(c) a compensation rope, the compensation rope having a first end and a second end, wherein the compensation rope is threaded through the plurality of upper sheaves and lower sheaves; and (d) a load sensor, the load sensor being associated with the compensation rope, wherein the load sensor is configured to measure the load of an elevator car.

2. The apparatus of claim 1, wherein the compensation rope is divided into a plurality of compensation rope portions extending between the upper sheave portion and the lower sheave portion, wherein each of the plurality of compensation rope portions bears a load.

3. The apparatus of claim 2, wherein the sum of the load borne by each of the plurality of compensation rope portions is equal to the total load of the elevator car.

4. The apparatus of claim 3, wherein the load of the elevator car is distributed equally to each of the plurality of compensation rope portions.

5. The apparatus of claim 4, wherein the load sensor is a single load sensor associated with one of the plurality of compensation rope portions.

6. The apparatus of claim 5, further comprising a computer, wherein the load measured by the single load sensor is multiplied by the number of compensation rope portions to calculate the total load of the elevator car.

7. The apparatus of claim 6, wherein the computer is configured to control the operation of an elevator based upon the total load of the elevator car.

8. The apparatus of claim 7, wherein the compensation rope comprises an aramid fiber rope.

9. The apparatus of claim 1, wherein the load cell is associated with the first end of the compensation rope.

10. The apparatus of claim 1, wherein the plurality of upper sheaves and the plurality of lower sheaves are arranged in an in-line configuration.

11. The apparatus of claim 1, wherein the plurality of upper sheaves and the plurality of lower sheaves are arranged in a grouped configuration.

12. The apparatus of claim 1, wherein the plurality of lower sheaves are full sheaves with bearings.

13. The apparatus of claim 1, wherein the plurality of lower sheaves are half sheaves.

14. An elevator system, comprising:

(a) an elevator car; and (b) a rope tension equalizer apparatus comprising (i) an upper sheave section, the upper sheave section having a plurality of upper sheaves;

(ii) a lower sheave section, the lower sheave section having a plurality of lower sheaves and wherein the lower sheave section is supported by the elevator car;

(iii) a compensation rope, the compensation rope having a first end and a second end, wherein the compensation rope is threaded through the plurality of upper sheaves and lower sheaves; and (iv) a load sensor, the load sensor being associated with the compensation rope, wherein the load sensor is configured to measure the load of the elevator car.

15. The system of claim 14, wherein the compensation rope is divided into a plurality of compensation rope portions extending between the upper sheave portion and the lower sheave portion, wherein each of the plurality of compensation rope portions bears a load.

16. The system of claim 15, wherein the sum of the load borne by each of the plurality of compensation rope portions is equal to the total load of the elevator car.

17. The system of claim 16, wherein the load of the elevator car is distributed equally to each of the plurality of compensation rope portions.

18. The system of claim 17, wherein the load sensor is a single load sensor associated with one of the plurality of compensation rope portions.

19. The system of claim 18, further comprising a computer, wherein the computer multiples the number of compensation rope portions by the load measured by the single load sensor to calculate the total load of the elevator car, and wherein the computer is configured to control the operation of an elevator based upon the total load of the elevator car.

20. A method of equalizing the tension between a plurality of elevator ropes, the method comprising the following steps:

providing an elevator system, the elevator system comprising (a) an elevator car, wherein the elevator car comprises a total load; and (b) a rope tension equalizer apparatus comprising (i) an upper sheave section, the upper sheave section having a plurality of upper sheaves;

(ii) a lower sheave section, the lower sheave section having a plurality of lower sheaves and wherein the lower sheave section is supported by the elevator car;

(iii) a compensation rope, the compensation rope having a first end and a second end, wherein the compensation rope is threaded through the plurality of upper sheaves and lower sheaves, and wherein the compensation rope comprises a tension; and (iv) a load sensor, the load sensor being associated with the compensation rope, wherein the load sensor is configured to measure the load of the elevator car;

measuring the tension existing in a portion of a compensation rope;

computing the total load of the elevator car; and directing the operation of the elevator car based upon the total load of the elevator car.

* * * * *